US011085748B1

(12) United States Patent
Steinkamp et al.

(10) Patent No.: US 11,085,748 B1
(45) Date of Patent: Aug. 10, 2021

(54) ENVIRONMENTALLY-FRIENDLY FIREWORKS DISPOSAL UNIT AND METHOD

(71) Applicant: Department of the Navy, Indian Head, MD (US)

(72) Inventors: Frank Lucus Steinkamp, Springfield, VA (US); Jesse Stuart Moran, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 466 days.

(21) Appl. No.: 15/732,174

(22) Filed: Sep. 29, 2017

(51) Int. Cl.

| | |
|---|---|
| ***F42B 33/06*** | (2006.01) |
| ***A62D 3/35*** | (2007.01) |
| ***C06B 21/00*** | (2006.01) |
| *A62D 101/06* | (2007.01) |

(52) U.S. Cl.
CPC ..... *F42B 33/06* (2013.01); *A62D 3/35* (2013.01); *C06B 21/0091* (2013.01); *A62D 2101/06* (2013.01)

(58) Field of Classification Search
CPC ..... F42B 33/06; A62D 3/35; A62D 2101/06; C06B 21/0091
USPC ..... 588/317
See application file for complete search history.

(56) References Cited

U.S. PATENT DOCUMENTS

| | | | |
|---|---|---|---|
| 3,778,320 | A | 12/1973 | Yosim et al. |
| 3,897,237 | A | 7/1975 | Musselman et al. |
| 3,930,844 | A | 1/1976 | Parrish et al. |
| 5,434,336 | A | 7/1995 | Adams et al. |
| 5,516,971 | A | 5/1996 | Hurley |
| 5,763,736 | A | 6/1998 | Daume |
| 6,121,506 | A | 9/2000 | Abel et al. |
| 6,245,958 | B1 | 6/2001 | Morse et al. |
| 6,388,164 | B1 | 5/2002 | Desmare et al. |
| 7,883,676 | B2 | 2/2011 | Hazelbeck et al. |
| 9,366,517 | B2 | 6/2016 | Kautz et al. |
| 2001/0049463 | A1 | 12/2001 | Heaton |
| 2014/0323792 | A1 | 10/2014 | Morris |

*Primary Examiner* — Edward M Johnson
(74) *Attorney, Agent, or Firm* — Fredric J. Zimmerman

(57) ABSTRACT

A method for destroying pyrotechnic materials including providing an apparatus having an inlet and an outlet and configured to mechanically destroy pyrotechnic materials and discharge pyrotechnic debris through the outlet, feeding water and pyrotechnic materials to the inlet of the apparatus so that the apparatus mechanically destroys the pyrotechnic materials and discharges pyrotechnic debris and water through the outlet, introducing the discharged pyrotechnic debris and water to a reservoir of water so that water-soluble components of the pyrotechnic debris dissolve into the water of the reservoir, light-density water-insoluble components float to the top of the reservoir and high-density water-insoluble components settle at bottom of the reservoir, and filtering the reservoir of water to separate water from the water-insoluble components.

10 Claims, 1 Drawing Sheet

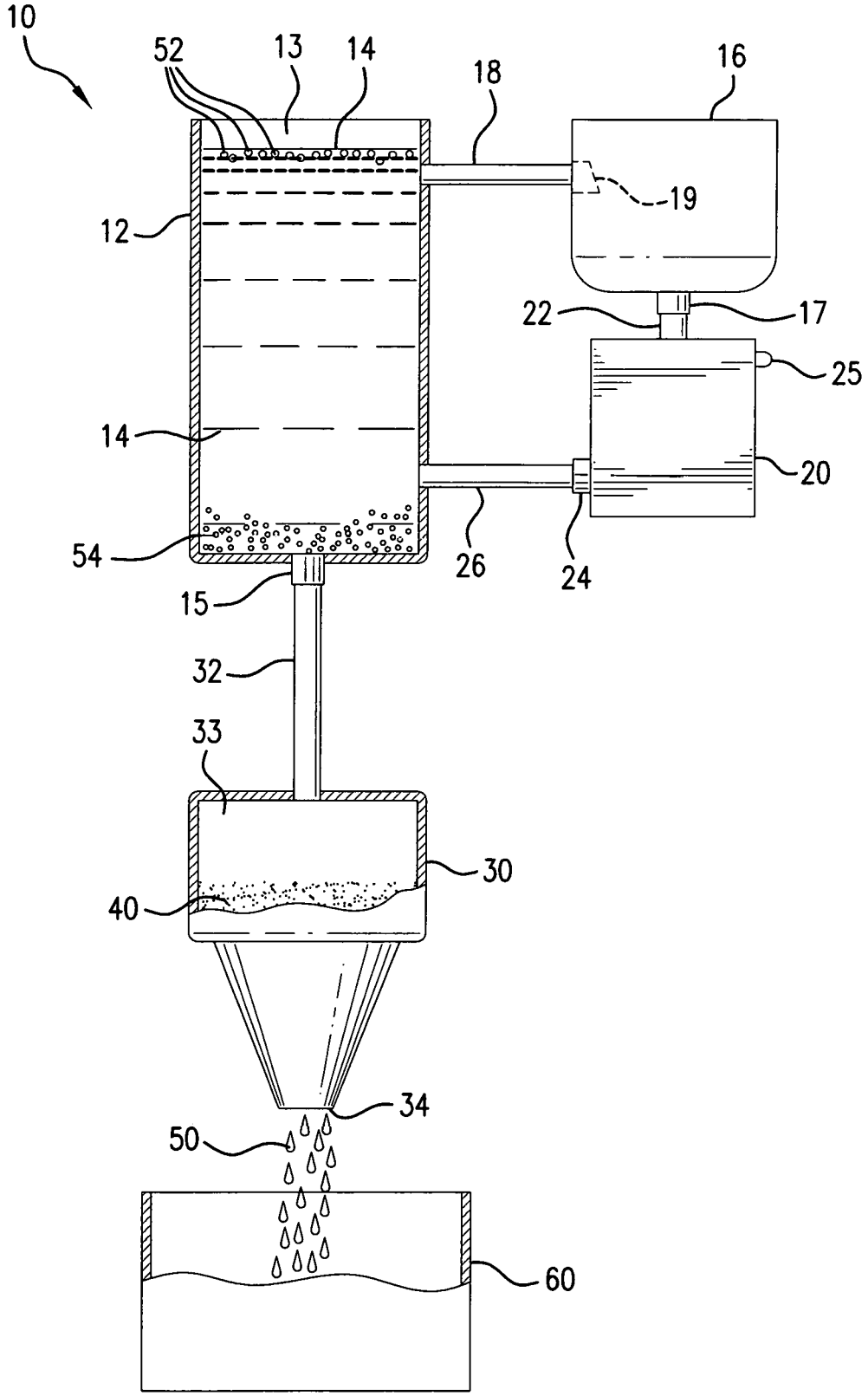
10
52
13
14
18
16
19
12
22
17
25
14
20
54
26
24
15
32
33
30
40
34
50
60

ENVIRONMENTALLY-FRIENDLY FIREWORKS DISPOSAL UNIT AND METHOD

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

FIELD OF THE INVENTION

The present invention relates to a method and system for destroying pyrotechnic materials.

BACKGROUND

Conventional practices and techniques for disposing of pyrotechnic materials, such as fireworks, typically require burning or incinerating the fireworks. However, burning or incinerating fireworks produces noxious gases and also causes the release of heavy metals and a variety of salts into the immediate area surrounding the incineration site. Thus, incinerating fireworks creates significant health hazards. Some conventional practices entail stacking the fireworks and then lighting the stack on fire. However, such a practice creates great risks to personnel since fires can quickly grow out of control. Furthermore, the fireworks can actually explode while being incinerated.

What is needed is a safe and cost effective method for disposing of pyrotechnic materials that eliminates the problems and disadvantages associated with the aforementioned conventional practices.

SUMMARY OF THE INVENTION

It is an aspect of the invention to provide a method for destroying pyrotechnic materials. The method includes the steps of providing an apparatus having an inlet and an outlet and configured to mechanically destroy pyrotechnic materials and discharge pyrotechnic debris through the outlet, feeding water and pyrotechnic materials to the inlet of the apparatus so that the apparatus mechanically destroys the pyrotechnic materials and discharges pyrotechnic debris and water through the outlet, introducing the discharged pyrotechnic debris and water to a reservoir of water so that water-soluble components of the pyrotechnic debris dissolve into the water of the reservoir, the light-density water-insoluble components of the pyrotechnic debris float to the top of the reservoir and the high-density water-insoluble components of the pyrotechnic debris settle at bottom of the reservoir, and filtering the reservoir of water to separate water from the water-insoluble components.

It is another aspect of the invention to provide a method for destroying pyrotechnic materials. The method includes the step of providing a system that includes a basin for holding water and pyrotechnic materials and a storage container for storing a reservoir of water and having a bottom. The system further includes a machine configured to mechanically destroy pyrotechnic materials so as to produce pyrotechnic debris. The machine includes an inlet fluidly coupled to the basin and an outlet for discharging the pyrotechnic debris. When the machine is activated, water and pyrotechnic materials in the basin flow into the machine wherein the machine mechanically destroys the pyrotechnic materials so as to produce pyrotechnic debris. The machine discharges the pyrotechnic debris and water through the outlet. The method includes the steps of feeding pyrotechnic material to the water in the basin and activating the machine to allow the pyrotechnic material and water in the basin to flow into the machine so that the machine mechanically destroys the pyrotechnic material and discharges water and the pyrotechnic debris through the outlet of the machine. The method further includes the step of introducing the discharged pyrotechnic debris and water to the reservoir of water so that water-soluble components of the pyrotechnic debris dissolve into the water of the reservoir, the light-density water-insoluble components of the pyrotechnic debris float to the top of the reservoir, and the high-density water-insoluble components of the pyrotechnic debris settle at the bottom of the storage container. The method includes the steps of removing the water and water-insoluble components from the storage container and filtering the water and water-insoluble components removed from the storage container to separate the water from the rater-insoluble components.

BRIEF DESCRIPTION OF THE DRAWINGS

FIG. 1 is a diagram illustrating the system for destroying pyrotechnic material in accordance with an exemplary embodiment of the present invention.

DETAILED DESCRIPTION OF EXEMPLARY EMBODIMENTS

As used herein, the term "mechanically destroy" includes destroying matter by shredding, crushing, grinding, chopping, pulverizing or breaking apart the matter.

As used herein, the term "pyrotechnic material" includes fireworks, matches, oxygen candles and flares, such as hand flares and flares fired by a gun or mortar.

Referring to FIG. 1, there is shown an exemplary embodiment of a system for implementing the method of the present invention. System 10 includes tank 12 which has interior 13 and is configured and sized to hold reservoir of water 14. Exterior portions of the tank 12 are cut away in FIG. 1 in order to facilitate viewing of interior 13 of tank 12. Tank 12 includes drain device 15 that is located at the bottom of tank 12. Drain device 15 is configurable to an open position, to allow water to drain from tank 12, or to a closed position that prevents draining of tank 12. In an exemplary embodiment, drain device 15 is manually operated. In another embodiment, drain device 15 is an electronically controlled drain. System 10 further includes sink 16 that is sized and configured to hold a liquid, such as water, along with a quantity of pyrotechnic material. In an exemplary embodiment, sink 16 includes drain 17. Fluid conduit 18 fluidly couples tank 12 to sink 16. Fluid conduit 18 includes outlet 19 (shown in phantom) that is located in sink 16. Water may flow from tank 12 to sink 16 when the level of water in sink 16 decreases below outlet 19.

System 10 further includes machine 20, which has inlet 22 and outlet 24. Inlet 22 is fluidly coupled to drain 17 of sink 16. Machine 20 is configured to destroy, mechanically, particles or materials that flow through machine 20. The resulting debris is discharged through outlet 24. In an exemplary embodiment, machine 20 may be a garbage disposal. Machine 20 is electrically powered and includes an electrical switch 25 for activating and deactivating machine 20. Machine 20 includes electrical wires (not shown) that are adapted to be electrically connected to a source of electrical power.

Referring to FIG. 1, system 10 further includes fluid conduit 26 that fluidly couples outlet 24 to tank 12. Fluid conduit 26 allows water and debris to flow from outlet 24 and into tank 12. Machine 20 is coupled to tank 12 and sink 16. System 10 further includes filter device 30 and fluid conduit 32. Fluid conduit 32 fluidly couples filter device 30 to drain device 15 of tank 12. When drain device 15 is open, water and water-insoluble matter flows through fluid conduit 32 to filter device 30, which separates the water from water-insoluble matter 40. Water-insoluble matter 40 is generally solid particulate and accumulates within interior 33 of filter 30. Filter device 30 includes outlet 34 from which filtered water 50 is discharged. In an exemplary embodiment, the outlet 34 is located at an end of a funnel shaped portion of the filter device. In an exemplary embodiment, filter device 30 is configured to provide access to the interior 33 of filter device 30 in order to allow users or operators to manually remove water-insoluble matter 40. Filter device 30 may also include one or more filter screens, which may be periodically removed and replaced or cleaned.

It is to be understood that other suitable devices may be used in place of tank 12 and sink 16. For example, suitable storage containers such as a vat or barrel may be used in place of tank 12. In such an embodiment, the vat or barrel is fluidly coupled to fluid conduit 18 and fluid conduit 32. In other example, sink 16 may be replaced by a basin or tub. In such an embodiment, the basin or tub is fluidly coupled to tank 12 and machine 20.

In order to use system 10 to destroy pyrotechnic materials in accordance with the invention, tank 12 and sink 16 are filled with water. The pyrotechnic materials to be destroyed are deposited in the water in sink 16. A user manipulates switch 25 to activate machine 20. Once activated, machine 20 causes the water and pyrotechnic material to flow down drain 17 and into inlet 22 of machine 20. As water and the pyrotechnic material flow down drain 17, the water level in sink 16 decreases below outlet 19 thereby causing water from tank 12 to flow through fluid conduit 18 and into sink 16 so as to refill or replenish sink 16 with water. Machine 20 mechanically destroys the pyrotechnic material so as to produce pyrotechnic debris. The pyrotechnic debris includes water-soluble components, low-density water-insoluble components and high-density water-insoluble components. Examples of water-soluble components are metal salts and oxidizer salts. Examples of water-insoluble components are charcoal, sulfur, cardboard or paper packaging. The pyrotechnic debris and water discharged through outlet 24 of machine 20 flows through fluid conduit 26 where it is introduced to the reservoir of water in tank 12. The water-soluble components dissolve in the reservoir of water in tank 12. The low-density water-insoluble components 52 rise to the surface of the reservoir of water and float on the surface. The high-density water-insoluble components 54 settle on the bottom of tank 12.

As described in the foregoing description, fluid conduit 18 allows water in tank 12 to automatically replenish sink 16 when the water level in sink 16 decreases below the location of outlet 19 of fluid conduit 18. As long as machine 20 remains activated, machine 20 continues to output debris and water which is introduced into tank 12 and replenishment water from tank 12 continues to flow through fluid conduit 18 and into sink 16 thereby forming a recirculation system. As a result of this recirculatory configuration, water in tank 12, including low-density water-insoluble components floating on the surface of the water, flow into sink 16 and then sucked down drain 17 and into machine 20 wherein the low-density water-insoluble components are further chopped, ground or pulverized, then discharged with water at outlet 24 and then reintroduced to the reservoir of water in tank 12. Any water-soluble components dissolve in the water in tank 12 while low-density water-insoluble components rise to the surface of the water in tank 12 and the high-density water-insoluble components settle at the bottom of tank 12. This recirculation function continues until machine 20 is deactivated.

Once machine 20 is deactivated, drain 15 on tank 12 is opened which causes the contents of tank 12 to flow through fluid conduit 32 into filter 30. Filter 30 filters out all water-insoluble components 40 (e.g. solid particulate) and outputs filtered water 50. Filtered water 50 contains the water-soluble components of the pyrotechnic debris. Filtered water 50 may be deposited into a storage container 60. Storage container 60 may be any suitable container such as a drum or barrel. Once storage container 60 has been filled with filtered water 50, the storage container 60 is sealed and then transported to a location or facility that processes chemical wastes. The solid particulates or water-insoluble components 40, which include charcoal, sulfur, wood splinters, cardboard and paper, combine to form a pulp-like particulate. Filter 30 is configured to provide access to the interior 33 of filter 30 so that the users or operators may remove the pulp-like particulate. The pulp-like particulate may be used as landfill.

In some embodiments, one or more flocculants are added to the reservoir of water in tank 12 to assist in the separation of water and solid particulate.

The foregoing description, for purpose of explanation, has been described with reference to specific exemplary embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

Finally, any numerical parameters set forth in the specification and attached claims are approximations (for example, by using the term "about") that may vary depending upon the desired properties sough to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method for destroying pyrotechnic materials, comprising:

providing an apparatus having an inlet and an outlet and being configured to mechanically destroy pyrotechnic materials and discharge pyrotechnic debris through the outlet;

feeding water and pyrotechnic materials to the inlet of the apparatus so that the apparatus mechanically destroys the pyrotechnic materials and discharges pyrotechnic debris and water through the outlet;

introducing the discharged pyrotechnic debris and water to a reservoir of water so that water-soluble components of the pyrotechnic debris dissolve into the water of the reservoir, light-density water-insoluble components of the pyrotechnic debris floating to the top of the reservoir and high-density water-insoluble components of the pyrotechnic debris settling at bottom of the reservoir; and filtering the reservoir of water for separating water from the water-insoluble components.

2. A method for destroying pyrotechnic materials, comprising:

providing a system including a bottom and a basin for holding water and pyrotechnic materials and a storage container for storing a reservoir of the water, the system further including a machine being configured to mechanically destroy pyrotechnic materials for producing pyrotechnic debris, the machine includes an inlet fluidly coupled to the basin and an outlet for discharging the pyrotechnic debris, wherein when the machine is activated, the water and the pyrotechnic materials in the basin flow into the machine, and wherein the machine mechanically destroys the pyrotechnic materials so as to produce pyrotechnic debris and discharges the pyrotechnic debris and water through the outlet;

feeding pyrotechnic material into the water in the basin;

activating the machine for allowing the pyrotechnic material and the water in the basin for flowing into the machine, wherein the machine mechanically destroys the pyrotechnic material and discharges water and the pyrotechnic debris through the outlet of the machine, wherein the pyrotechnic debris includes water-soluble components and water-insoluble components, and wherein the water-insoluble components include light-density water-insoluble components and high-density water-insoluble components;

introducing the discharged pyrotechnic debris and water to the reservoir of water so that the water-soluble components dissolve into the water of the reservoir, the light-density water-insoluble components float to the top of the reservoir, and the high-density water-insoluble components settle at the bottom of the storage container;

removing the water and the water-insoluble components from the storage container; and filtering the water and the water-insoluble components removed from the storage container to separate the water from solid particulate.

3. The method according to claim 1, further comprising deactivating the machine before said removing the water and the water-insoluble components from the storage container.

4. The method according to claim 1, further comprising replenishing the basin with water from the storage container before the removing the water and the water-insoluble components from the storage container, wherein the activated machine causes the replenished water to flow from the basin and into the inlet of the machine;

discharging the replenished water through the outlet of the machine after said replenishing the basin and before said removing the water and the water-insoluble components from the storage container; and reintroducing the replenished water discharged through the outlet of the machine to the reservoir of water in the storage container after said discharging the replenished water and before said removing the water and the water-insoluble components from the storage container.

5. The method according to claim 4, further comprising repeating the replenishing, the discharging and the reintroducing steps for a predetermined amount of time.

6. The method according to claim 4, further comprising repeating the replenishing, the discharging and the reintroducing steps for a predetermined amount of time; and deactivating the machine after the predetermined amount of time has elapsed and before said removing the water and the water-insoluble components from the storage container.

7. The method according to claim 1, wherein the removing the water and the water-insoluble components from the storage container comprises the draining the water and the water-insoluble components from the storage container.

8. A method of destroying pyrotechnic materials, comprising:

providing a system that includes a water tank containing a reservoir of water and having a drain device, a sink fluidly coupled to the water tank and configured to hold an amount of water and pyrotechnic material, a machine fluidly coupled to the sink and having an outlet fluidly coupled to the water tank, the machine being configured to mechanically destroy pyrotechnic materials, wherein when the machine is activated, water and pyrotechnic materials in the sink flow into the machine which mechanically destroys the pyrotechnic materials so as to produce pyrotechnic debris and discharges the pyrotechnic debris and water through the outlet, the system including a filter fluidly coupled to the drain device of the water tank;

filling the sink with water from the reservoir of water in the water tank;

feeding pyrotechnic material into the water in the sink;

activating the machine so that water and pyrotechnic materials in the sink flow into the machine such that the machine mechanically destroys the pyrotechnic materials so as to produce pyrotechnic debris and discharges the pyrotechnic debris and water through the outlet;

introducing the discharged pyrotechnic debris and water to the reservoir of water in the water tank so that water-soluble components of the pyrotechnic debris dissolve in the reservoir of water, low-density water-insoluble components of the pyrotechnic debris float to the surface of the reservoir of water and high-density water-insoluble components of the pyrotechnic debris settle at the bottom of the water tank;

replenishing the sink with water from the reservoir of water in the water tank, wherein the activated machine causes the replenished water to flow into the inlet of the machine;

discharging the replenished water from the outlet of the machine;

reintroducing the discharged replenished water to the reservoir of water in the water tank;

draining water and water-insoluble components out of the water tank; and filtering the water and water-insoluble components drained from the water tank so as to separate the water from the solid particulate.

9. The method according to claim 8 including a step of repeating the replenishing, discharging and reintroducing steps for a predetermined amount of time before the step of draining the water and water-insoluble components from the water tank.

10. The method according to claim 8 including a step of deactivating the machine before the step of draining the water and water-insoluble components from the water tank.

* * * * *